US006267316B1

(12) United States Patent
Cross

(10) Patent No.: US 6,267,316 B1
(45) Date of Patent: Jul. 31, 2001

(54) PORTABLE PAPER TOWEL HOLDER

(76) Inventor: Lee A. Cross, 10500 Gabriella Dr., Parma, OH (US) 44130

( * ) Notice: Subject to any disclaimer, the term of this patent is extended or adjusted under 35 U.S.C. 154(b) by 0 days.

(21) Appl. No.: 09/458,031

(22) Filed: Dec. 8, 1999

(51) Int. Cl.[7] ..... B65H 23/06

(52) U.S. Cl. ..... 242/422.5; 242/588; D6/522; D6/523

(58) Field of Search ..... 242/422.5, 422.9, 242/588, 588.1, 588.2, 129; D6/522, 523

(56) References Cited

U.S. PATENT DOCUMENTS

| | | | | |
|---|---|---|---|---|
| 2,477,803 | * | 8/1949 | Huber | 439/137 |
| 3,317,881 | * | 5/1967 | Setecka | 439/140 |
| 4,925,396 | * | 5/1990 | Grover | 439/147 |
| 5,082,450 | * | 1/1992 | Warren, Sr. et al. | 439/102 |
| 5,393,237 | * | 2/1995 | Roy et al. | 439/134 |
| 5,485,340 | * | 1/1996 | Avitan | 361/45 |
| 5,551,884 | * | 9/1996 | Burkhart, Sr. | 439/140 |
| 5,791,931 | * | 8/1998 | Burkhart, Sr. | 439/346 |
| 5,813,873 | * | 9/1998 | McBain et al. | 439/145 |
| 5,944,542 | * | 8/1999 | Lee | 439/140 |
| 5,946,180 | * | 8/1999 | Simpson | 361/93.3 |

* cited by examiner

*Primary Examiner*—John Q. Nguyen
(74) *Attorney, Agent, or Firm*—John D. Gugliotta; Michael J. Corrigan

(57) ABSTRACT

A portable dispenser of paper towels or other paper roll products. This device effectively dispenses paper towels in the work area at any place the user wishes to place the device. The device is made of PVC or similar tubing and suction cups to enable the base of the holder to be secured on any work surface. The paper towel roll is inserted and used as needed.

7 Claims, 4 Drawing Sheets

PORTABLE PAPER TOWEL HOLDER

RELATED APPLICATIONS

There are no previously filed, nor currently any co-pending applications, anywhere in the world.

BACKGROUND OF THE INVENTION

1. Field of the Invention

The present invention relates generally to paper towel holders and, more particularly, to a portable paper towel holder with suction cups for mounting at the user's convenience.

2. Description of the Related Art

Paper towels have found use in just about every household. Their convenience, low-cost and ability to clean up just about any mess or perform any cleaning task makes them valuable indeed. While usually found in kitchens, mounted to a permanent, dispensing holder, they do have uses elsewhere. However, when they are used elsewhere, they are often used loosely, without a dispenser. This often results in wasted product when more is removed than necessary or the entire roll is dropped and becomes contaminated by liquid or dirt along the edges. Also, many tasks are performed at the work site, rather than at a static location. These locations include boats, camping, motor vehicle work, garages, work shops, gardening tables and the like. It is not economically feasible to provide permanent paper towel holders at all of the locations. Even if it was, the paper towel holder would often get in the way of the work process itself. Accordingly, there is a need for a means by which paper towels can be dispensed at many locations using a semipermanent dispenser that can be removed and reattached easily. The development of the Portable Paper Towel Holder with Suction Cup Mount fulfills this need.

In the related art, there exists patents for various portable paper towel holders/dispensers. Most notably are the type whereby a roll of conventional paper towels is slid over a vertically oriented shaft mounted on a base. One need to only pick up the entire assembly and carry it with them. This design has one major drawback in that it has no means to mount it to a surface. This can be very inconvenient. The present invention mounts a roll of conventional paper towels on a horizontally oriented spindle for dispensing as is customary. It also includes a suction cup means for temporarily attaching it to virtually any flat surface, and a spring loaded or similar bar across the top of the towels which then prevents the towels from unrolling prematurely all greatly increase the convenience to the user.

A search of the prior art did not disclose any patents that read directly on the claims of the instant invention; however, the following references were considered related:

| U.S. Pat. No. | Inventor | Issue Date |
|---|---|---|
| 5,490,625 | Myatt | Feb. 13, 1996 |
| 5,172,966 | Myatt | Dec. 22, 1992 |
| 5,104,054 | Latham | Apr. 14, 1992 |
| 4,690,345 | Cotey | Sep. 1, 1987 |
| 5,244,220 | Cortez | Sep. 14, 1993 |
| 4,030,676 | Bardsley | June 21, 1977 |
| D 326,203 | Butler | May 19, 1992 |
| D 253,265 | Miller | Oct. 30, 1979 |

SUMMARY OF THE INVENTION

It is therefore an object of the present invention to provide a portable paper towel holder.

It is another object of the present invention to provide to allow paper towels to be used anywhere.

It is yet another object of the present invention to keep paper towels clean and readily available.

It is still yet another object of the present invention to provide a plastic mounting frame where one side opens to accept new rolls of paper towels.

It is another object of the present invention to provide a towel holder that has a unique tension bar across the roll to keep the towels from unrolling prematurely.

It is another object of the present invention to provide suction cup mounts to securely mount the device on any smooth nonporous surface.

It is a feature of the present invention to accommodate any size roll of paper towels.

It is another feature of the present invention that it can be mounted in any position, even upside down or sideways.

It is an advantage of the present invention that it can be relocated to accommodate changing work tasks, but keeps paper towels handy.

Briefly described according to one embodiment of the present invention, the Portable Paper Towel Holder with Suction Cup Mount, as its name implies, is a portable paper towel holder and dispenser. A conventional roll of paper towels mount on the center portion of a general "H" shaped frame. Each of the four ends of the "H" shaped frame is provided with a leg that extends downward to provide the necessary clearance to the mounting surface. At the end of each of the four legs is a suction cup that allows for the attachment of the invention along with the associated roll of paper towels in a secure manner to any smooth, non-porous surfaces in any position. The invention provides for the dispensing of paper towels in a manner identical to that of a conventional paper towel holder. When the roll of towels is depleted, the invention slides apart at the end portion to allow for a new roll to be installed. The use of the Portable Paper Towel Holder with Suction Cup Mount allows one to use paper towels at the work site on a temporary basis such as mechanics benches, work stations, basements or similar locations. The holder can easily be removed when no longer required without leaving any marks.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| LIST OF REFERENCE NUMBERS | |
|---|---|
| 10 | Portable Paper Towel Holder |
| 15 | Spindle |
| 16 | Tee |
| 17a | "D" shaped aperture |
| 17 | Nipple |
| 17a | "D" shaped aperture |
| 18 | Elbow |
| 19 | Leg |
| 20 | Leg Cap |
| 20a | Aperture |
| 21 | Suction Cup |
| 21a | Suction Cup Nipple |
| 21b | Release Tab |
| 22 | Gripper Bar |
| 22a | Spring loaded "D" shaped pin |
| 22b | Tab |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
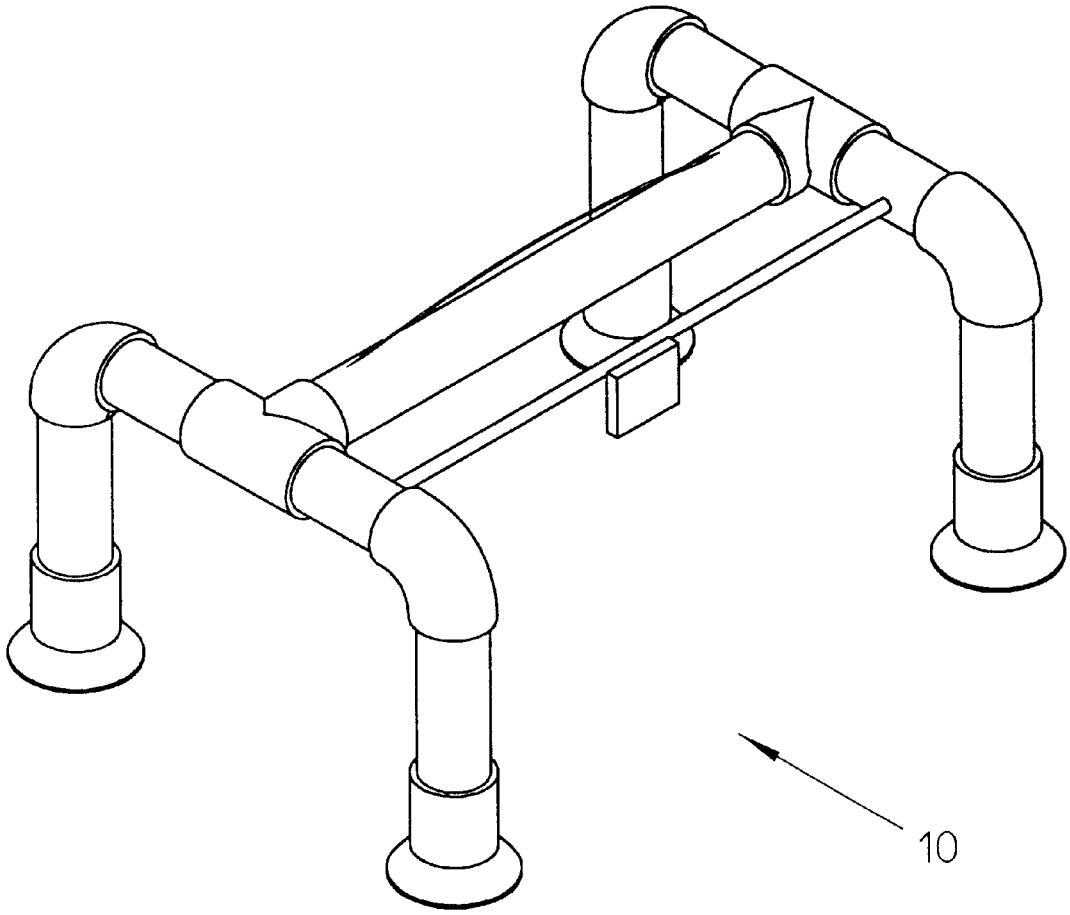
FIG. 1 is a perspective view of a Portable Paper Towel Holder, according to the preferred embodiment of the present invention.
Figure 2:
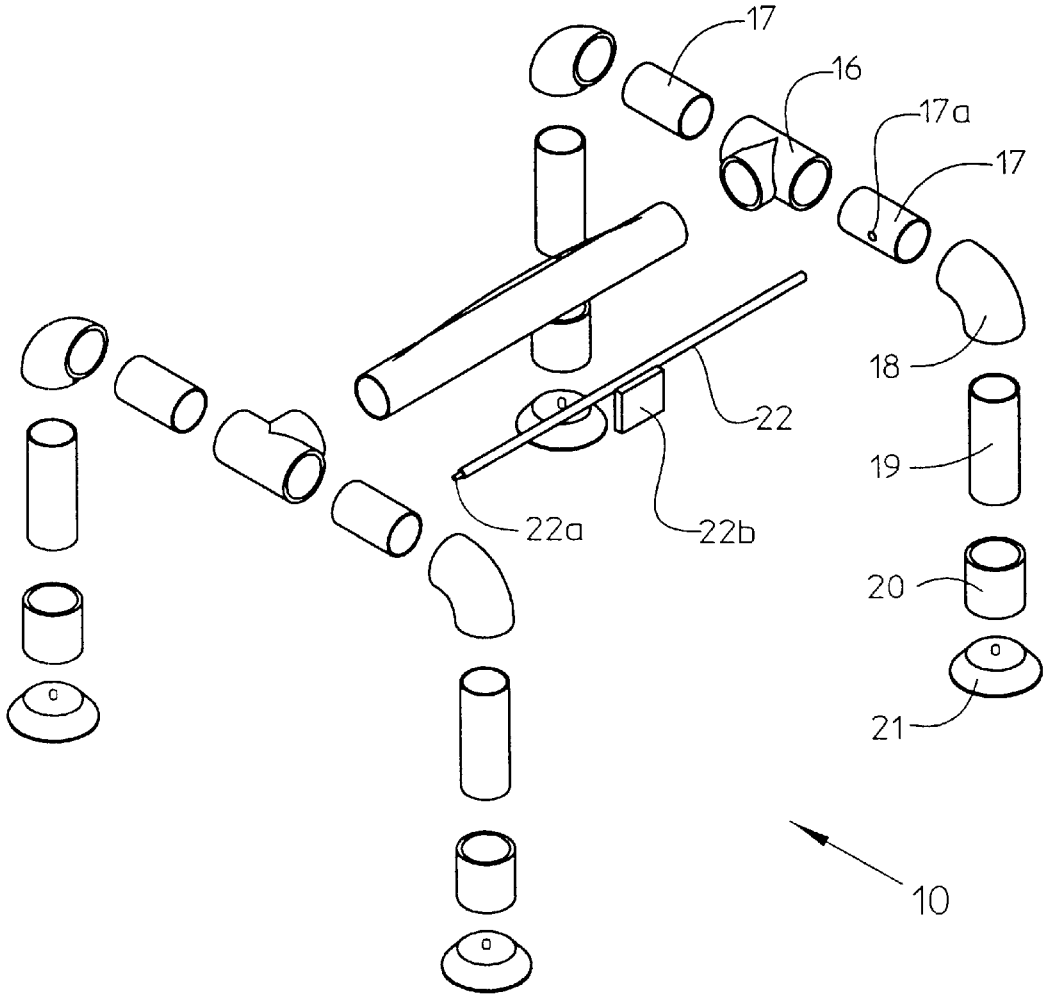
FIG. 2 is an exploded perspective view of a Portable Paper Towel Holder, according to the preferred embodiment of the present invention.

Referring now to FIG. 1, a Portable Paper Tower Holder 10 is shown, according to the present invention, having a means whereby the device can be securely attached and then removed at the user's convenience. The device would have unlimited application in the home, garage, office, or wherever one may need to have a paper towel handy on a temporary or semi-permanent basis. One can easily take it with them while working under the hood of the car and then take it back into the house. FIG. 2 shows an exploded perspective view of the portable Paper Towel Holder 10 comprised of a center spindle 15 having an elongated longitudinal axis and two ends, a plurality of two tee fittings 16 fitted one each on said ends, a plurality of four nipple sections 17 wherein two of said plurality of four nipple sections 17 are fitted into each of said plurality of two tee fittings 16 and oriented as shown, and a plurality of four elbows 18 wherein one of said plurality of four elbows 18 is fitted onto each of said nipple sections 17. A specially designed gripper bar 22 is rotatably suspended between the two forward nipples 17 via spring loaded "D" shaped pins 22*a* which are received by a "D" shaped aperture 17*a* formed in said nipples 17. Gripper bar 22 is spring loaded and biased so that a tab 22*b* is forced against the paper towel roll to keep it from turning and unrolling prematurely. This embodiment of gripper bar 22 is meant as only as a suggestion and other means for preventing the paper towel roll from unrolling may be employed according to the manufacturer's desire. Each of said plurality of four elbows 18 is oriented so that any section of piping fitted in the open end would be oriented 90° downward from the elongated longitudinal axis of spindle 15. One end of a leg 19 from a plurality of four legs 19 is then inserted into an elbow 18 from the plurality of four elbows and oriented as described. An end cap 20 from a plurality of four end caps 20 is then fitted onto the other end of each of said leg 19. A suction cup 21 from a plurality of four suction cups 21 is then attached to each one of said end cap 20 via means described hereinbelow. A special release tab 21*b* is integrally built into each suction cup 21 to break the suction seal between the suction cup 21 and a surface.

Spindle 15, nipple 17, and leg 19 are all made and cut to length from PVC tubing or equivalent. ¾" diameter tubing is suggested but in no way is that meant to be limiting. Likewise, tee fitting 16, elbow 18, end cap 20 are made from the same material and sized to receive the ends of said tubing. All connections are made by sliding the tubing in the appropriate end into a fitting in a semi-interference fit. No glue is required or desired as the device can be broken down as desired for storage or transport. Upon assembly, a roll of conventional paper towels is slide over spindle 15 before the tee fittings 16 are slid onto spindle 15. Then the remaining components are assembled. Spindle 15 is approximately 13" in length, or slightly longer than a roll of conventional paper towels. Likewise, legs 19 can be any length but they must be at least as long as the diameter of a roll of conventional paper towels so that the roll will not contact the surface the device is mounted on. When assembled, the device is a portable, stand alone structure capable of supporting a roll of conventional paper towels thereon.

Figure 3:
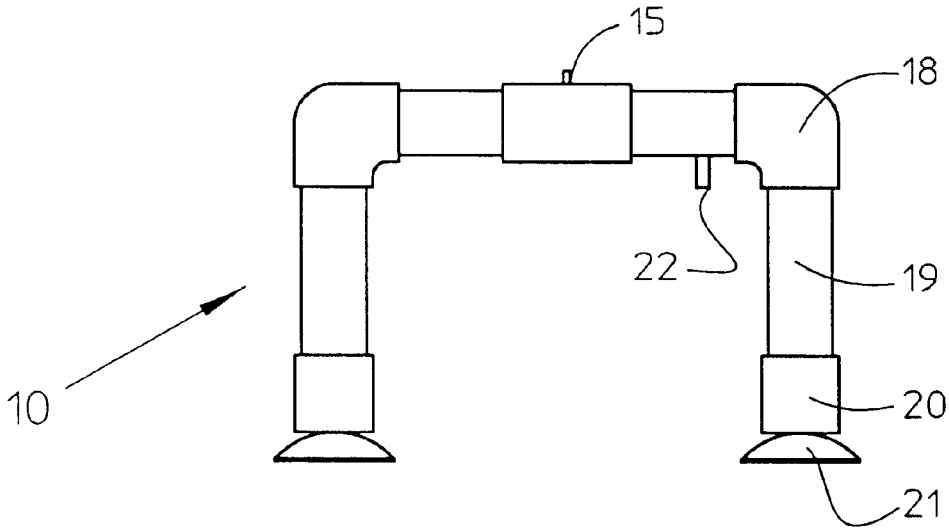
FIG. 3 is a side view of a Portable Paper Towel Holder, according to the preferred embodiment of the present invention.
Figure 4:
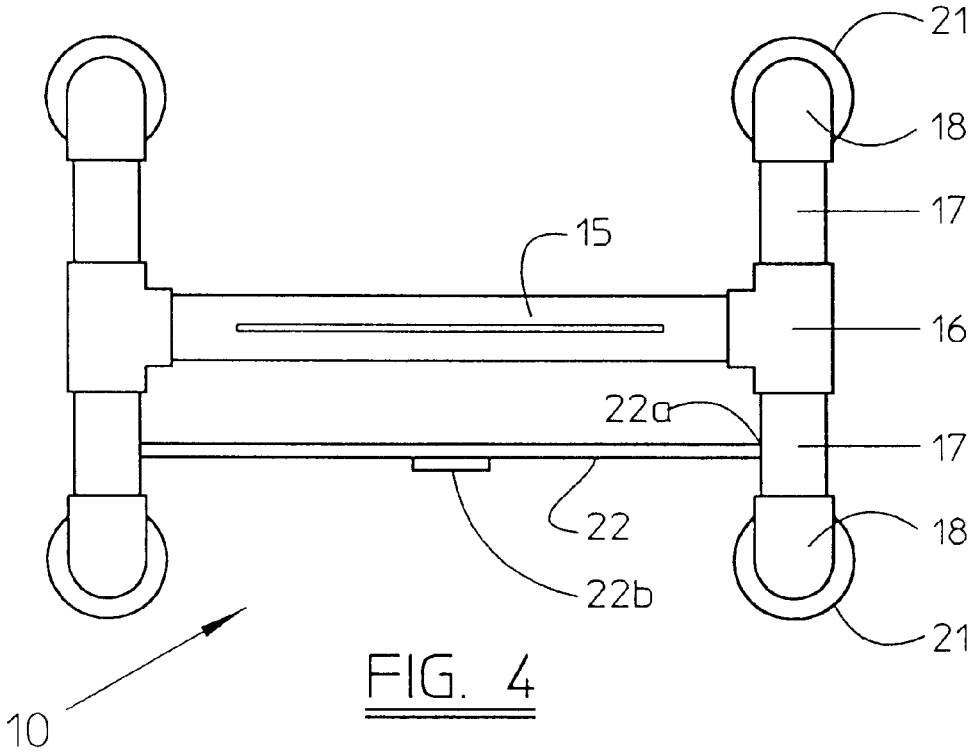
FIG. 4 is a top view of a Portable Paper Towel Holder, according to the preferred embodiment of the present invention.
Figure 5:
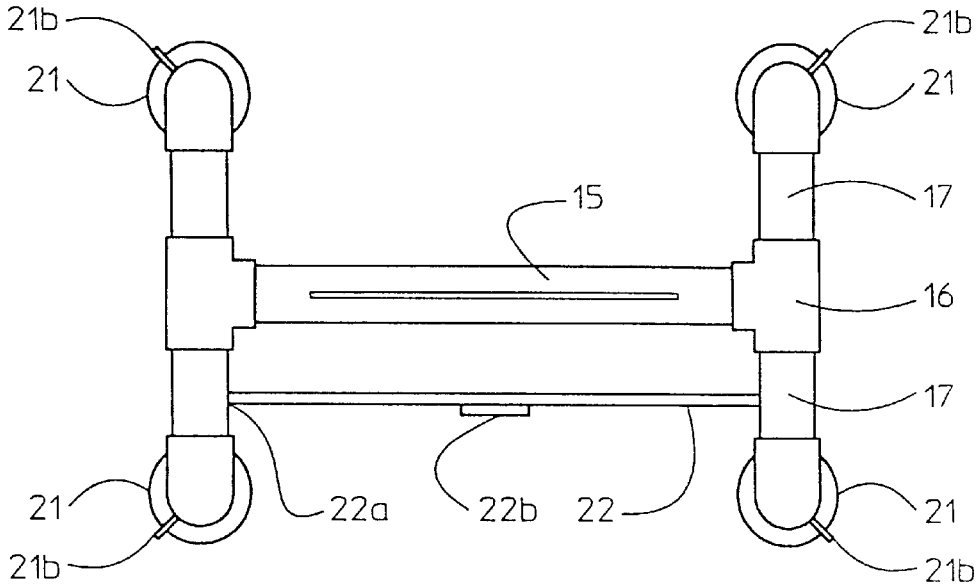
FIG. 5 is a top view of a Portable Paper Towel Holder, according to the preferred embodiment of the present invention.
Figure 6:
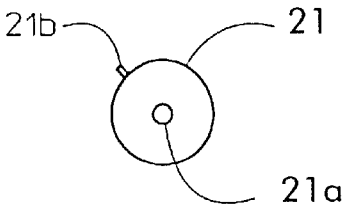
FIG. 6 is a bottom view of an end cap from a Portable Paper Towel Holder, according to the preferred embodiment of the present invention.
Figure 7A:
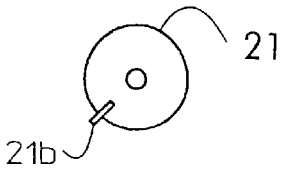
FIG. 7*a* is a top view of a suction cup from a Portable Paper Towel Holder, according to the preferred embodiment of the present invention.
Figure 7B:
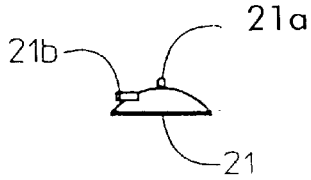
FIG. 7*b* is a side view of a suction cup from a Portable Paper Towel Holder, according to the preferred embodiment of the present invention.

Referring to FIGS. 3 through 5, various views a Portable Paper Towel Holder 10 is shown, detailing the structure of the device. FIG. 6 is a bottom view of end cap 20 with a small aperture 20*a* located in the center. Aperture 20*a* is for receiving a nipple 21*a* located on the upper surface of suction cup 21 as shown in FIGS. 7*a* and 7*b*. Nipple 21*a* snaps into aperture 20*a* in a snug interference type fit. A release tab 21*b* is provided to release suction cup 21 from a surface. However, this means for attaching suction cup 21 is meant as only as a suggestion and other means may be employed depending on the means which the manufacturer of the suction cup selected has chosen.

2. Operation of the Preferred Embodiment

To use the present invention, one simply slips a roll of conventional paper towels over the center spindle, and then slides the "T" fittings onto the spindle. Next, two "U" shaped feet sections are slid onto the "T" sections. The feet sections have suction cups attached to them for mounting on a surface. One need only select a suitable surface and gently push on the device to install. To release, a gentle tug on the release tabs extending from the cup base is all that is required to detach it from the surface. A spring loaded bar is provided to prevent the paper towel roll from unrolling prematurely. The entire device may also be disassembled for storage by simply pulling the sections of tubing from the fittings.

The foregoing description is included to illustrate the operation of the preferred embodiment and is not meant to limit the scope of the invention. The scope of the invention is to be limited only by the following claims.

What is claimed is:

1. A portable paper towel holder for dispensing a conventional roll of paper towels, comprising:

a center spindle, said center spindle having an elongated longitudinal axis and two ends;

a plurality of two tee fittings, wherein one tee fitting from said plurality of two tee fittings is fitted onto each of said ends;

a plurality of four nipple sections, wherein two of said plurality of four nipple sections are fitted into respective ends of each of said plurality of two tee fittings;

a plurality of four elbows, wherein one of said plurality of four elbows is fitted onto each of said nipple sections;

a plurality of four legs, wherein one of said plurality of four legs is fitted into each of said plurality of four elbows;

a plurality of four end caps, wherein one of said four plurality of four end caps is fitted on each of said plurality of four legs;

a plurality of four suction cups, wherein one of said plurality of four suction cups is attached to each of said plurality of four ends caps;

a gripper bar, said gripper bar being rotatably suspended between the front two nipples of said plurality of four nipples and spring loaded and biased so a tab is forced against said roll of paper towels on said spindle to keep the roll from turning and unrolling prematurely; and a means for attaching said plurality of four suction cups to said plurality of four ends caps.

2. The portable paper towel holder of claim 1, wherein each of said plurality of four elbows is oriented so that one of the legs from the plurality of four legs fitted in an open end thereof would be oriented 90° downward from the elongated longitudinal axis of said spindle.

3. The portable paper towel holder of claim 2, wherein said spindle, said plurality of four nipple sections, and said plurality of four legs are all made and cut to length from PVC tubing, and wherein said plurality of two tee fittings and said plurality of four elbows are made from PVC.

4. The portable paper towel holder of claim 3, wherein said spindle is specially designed to be spring loaded to prevent said roll of paper towels from unrolling prematurely.

5. The portable paper towel holder of claim 4, wherein said attachment means is comprised of a small aperture located in a bottom of each of said plurality of four end caps for receiving a nipple located on an upper surface of each of said plurality of four suction cups in a snug interference type fit.

6. The portable paper towel holder of claim 5, wherein all connections made between said plurality of two tee fittings, said plurality of four elbows and said spindle, said plurality of four nipple sections, and said plurality of four legs are made by sliding together in a semi-interference type fit.

7. The portable paper towel holder of claim 6, wherein said holder may also be disassembled for storage by simply pulling said plurality of four nipple sections, said spindle, and said plurality of four legs from said plurality of two tee fittings and said plurality of four elbows.

* * * * *